US005150795A

United States Patent [19]

Nakayama et al.

[11] Patent Number: 5,150,795

[45] Date of Patent: Sep. 29, 1992

[54] APPARATUS FOR SORTING SPECIMENS

[75] Inventors: Naoki Nakayama, Tsukuba; Katumi Hamasaki, Yokohama, both of Japan

[73] Assignee: Mitsubishi Petrochemical Engineering Company Ltd., Tokyo, Japan

[21] Appl. No.: 730,986

[22] Filed: Jul. 16, 1991

[30] Foreign Application Priority Data

Jul. 16, 1990 [JP] Japan ..... 2-185191

[51] Int. Cl.[5] ..... B07C 3/14

[52] U.S. Cl. ..... 209/3.3; 209/569; 209/557

[58] Field of Search ..... 209/3.1, 3.3, 546, 549, 209/556, 557, 569, 630, 651, 653, 702; 198/358, 349

[56] References Cited

U.S. PATENT DOCUMENTS

| | | | |
|---|---|---|---|
| 3,040,323 | 6/1962 | Brenner et al. | 209/569 X |
| 3,173,533 | 3/1965 | Zuck | 209/569 X |
| 3,645,391 | 2/1972 | Hirakawa et al. | 209/3.3 |
| 3,803,556 | 4/1974 | Duffy | 198/349 X |
| 4,398,637 | 8/1983 | Fleury | 209/3.3 X |
| 4,610,359 | 9/1986 | Muller | 209/557 X |
| 4,776,464 | 10/1988 | Miller et al. | 209/3.3 |
| 4,992,649 | 2/1991 | Mampe et al. | 209/546 X |

FOREIGN PATENT DOCUMENTS

| | | | |
|---|---|---|---|
| 3725588 | 2/1989 | Fed. Rep. of Germany | 198/349 |
| 0100055 | 8/1979 | Japan | 209/653 |

*Primary Examiner*—Robert P. Olszewski
*Assistant Examiner*—James R. Bidwell
*Attorney, Agent, or Firm*—Wenderoth, Lind & Ponack

[57] ABSTRACT

A specimen sorting apparatus sorts specimens such as blood or urea from different subjects into predetermined classes according to examination items. The apparatus has a path of convey including a rack transporting conveyor and a rack sorting conveyor connected to the downsream end of the rack transporting conveyor, a rack supply conveyor provided at one side of the rack transporting conveyor, a first specimen bar code reader disposed in the vicinity of the rack supply conveyor, a printer disposed near the downstream end of the rack transporting conveyor and adapted to operate in accordance with instructions given by a host computer, a rack bar code reader and a second specimen bar code reader disposed along the path of convey between the rack supply conveyor and the printer, a table disposed at one side of the rack sorting conveyor and having a predetermined number of storage sections defined thereon and a plurality of pusher mechanisms arranged along the rack sorting conveyor and associated with the respective storage sections.

3 Claims, 3 Drawing Sheets

APPARATUS FOR SORTING SPECIMENS

BACKGROUND OF THE INVENTION

1. Field of the Invention

The present invention relates to an apparatus for classifying specimens into predetermined classes in accordance with specimen identification numbers ($ID_0No$), automatically printing examination item identification numbers ($ID_2No$) on the classified specimens in accordance with instructions given by a computer, and then sorting the specimens. More particularly, the present invention is concerned with an apparatus which sorts a plurality of specimens such as blood from different subjects by using specimen containers and racks which carry a predetermined number of such containers.

2. Description of the Related Art

Remarkable progress has been made in the field of clinical examinations for analyzing specimens such as blood or urea by various methods for the purpose of diagnosis on the basis of the analytical data. Nowadays, systems have been developed for enabling automatic analysis and examination.

These automatic systems, however, still require various manual preparatory work which have to be conducted before introducing the specimens into the analytical and examination process. For instance, manual labor has been required for reading specimen identification numbers $ID_0No$ and for labeling examination item identification numbers $ID_2No$ as well as for the sorting work itself, which are allotted for the purpose of enabling sorting of specimens according to analysis and examination items.

Such manual preparatory work is generally inefficient, thus hampering efficiency in analysis and examination, making it difficult to enjoy the merits of automatic analysis and examination systems.

Japanese Patent Laid-Open No. 60-114768 discloses a system which has a conveyor line for conveying a multiplicity of specimen containers, an identification code reading device, and a computer for processing analytical data. The system operates in accordance with instructions given by the computer such that specimens which require manual analysis are introduced to a manual analysis station, and specimens requiring re-examination are sent to a re-examination station, while other specimens are conveyed to a storage station.

A system disclosed in Japanese Utility Model Laid-Open No. 62-115181 includes a specimen arrangement determining chamber for accommodating specimen racks, a rack conveying means, a sampling line for automatically analyzing the specimens for each of the measuring items, means for determining whether or not a re-examination is necessary and for sending the specimens requiring re-examination to a specimen collecting chamber, means for resending the examination racks to the sampling line, and a control means for controlling the operation of the described means. This system, however, lacks any reading device.

Japanese Patent Laid-Open No. 63-52061 discloses a system which includes an automatic sorting device for putting specimen racks on the main path of convey, a reading device for reading destinations of the racks and branch paths through which the racks are conveyed from the main path to the respective examination devices. The system also has a controller which appoints, in accordance with data stored in a memory, the specimen racks which are to be put on the main path of convey after completion of the examination.

SUMMARY OF THE INVENTION

According to the present invention, there is provided a specimen sorting apparatus, comprising: a path of convey including a rack transporting conveyor and a rack sorting conveyor connected to the downstream end of the rack transporting conveyor; a rack supply conveyor provided at one side of the rack transporting conveyor; a first specimen bar code reader disposed in the vicinity of the rack supply conveyor; a printer disposed near the downstream end of the rack transporting conveyor and adapted to operate in accordance with instructions given by a host computer; a rack bar code reader and a second specimen bar code reader disposed along the path of covey between the rack supply conveyor and the printer; a table disposed at one side of the rack sorting conveyor and having a predetermined number of storage sections defined thereon; and a plurality of pusher mechanisms arranged along the rack sorting conveyor and associated with the respective storage sections; whereby the sorting of specimens is conducted by loading predetermined racks with a predetermined number of specimen containers in accordance with the specimen identification numbers $ID_0No$ marked on the specimen containers which are read by the first specimen bar code reader; transferring the racks onto the rack supply conveyor and then to the rack transporting conveyor; reading the rack identification number of each rack by the rack bar code reader and reading the specimen identification numbers $ID_0No$ of the specimen containers on the rack by the second specimen bar code reader during the running of the rack by the rack transporting conveyor; printing examination item identification numbers $ID_2No$ on the specimen containers by the printer in accordance with instructions given by a host computer; transferring the racks after printing on the specimen containers thereon to the rack sorting conveyor from the rack transporting conveyor; and selectively operating the pusher mechanisms in accordance with instructions given by the host computer thereby pushing the racks into corresponding storage sections.

Thus, according to the invention, the examination item identification numbers $ID_2No$ are automatically printed on specimens which have been coarsely classified according to predetermined classes, and are then re-combined and gathered in accordance with the examination item identification numbers $ID_2No$.

DESCRIPTION OF THE PREFERRED EMBODIMENT

A preferred embodiment of the specimen sorting apparatus of the present invention will be described with reference to the accompanying drawings.

Figure 1:
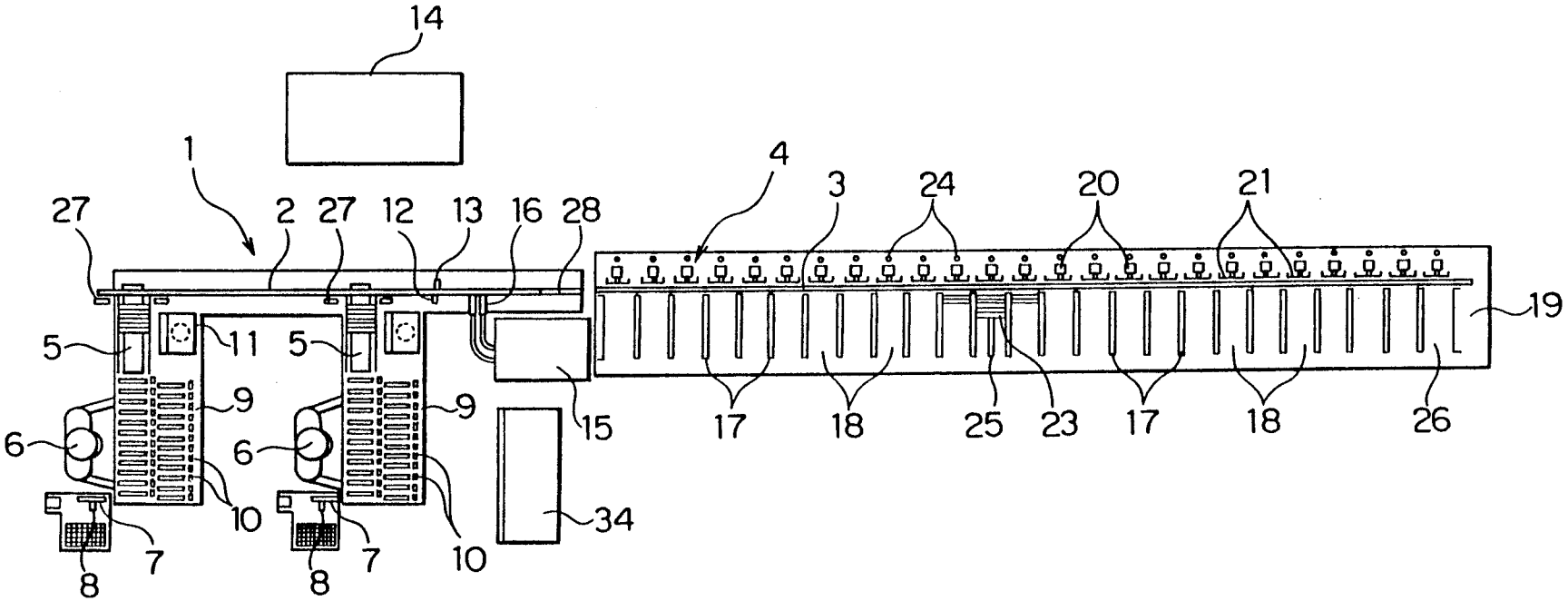
FIG. 1 is a schematic illustration of a specimen sorting apparatus in accordance with the present invention.

Referring to the drawings, particularly to FIG. 1, the specimen sorting apparatus 1 has a linear continuous path 4 of convey composed of a rack transporting conveyor 2 and a rack sorting conveyor 3 which is connected to the rack transporting conveyor 2.

Rack supply conveyors 5 are continuously or orthogonally connected to one side of the rack transporting conveyor 2. An operator's seat 6 is provided at one side of the starting or upstream end of each rack supply conveyor 5. A first specimen bar code reader 8 having a reading guide 7 is disposed on the right side of each operator's seat 6.

A coarse sorting table 9 for a coarse sorting into a plurality of classes, e.g., 24 (twenty four) classes in the illustrated case, is disposed in front of each operator's seat 6. Each coarse sorting table 9 has 24 (twenty four) class indicator lamps 10.

A control panel 11 is disposed on the side of each rack supply conveyor 5 opposite to the operator's seat 6, at a position near the downstream end of the rack supply conveyor 5.

Although not exclusive, a pair of operator's seats 6 are provided in the illustrated embodiment, and devices such as the rack supply conveyors 5, the bar code readers 8 are arranged in the same manner for both operator's seats 6.

A rack bar code reader 12, a second specimen bar code reader 13 and a printer 16 are disposed at one side of the rack transporting conveyor 2. The printer 16 is provided with a control panel 15 and is operated in accordance with instructions given by a host computer 14. A table 19 is disposed at one side, the proximal side as viewed in FIG. 1, of the rack sorting conveyor 3 which is connected to the rack transporting conveyor 2. The table 19 carries a plurality of sorted rack stock yards 18 which are defined by partitions 17, 17 perpendicular to the rack sorting conveyor 3. In the illustrated embodiment, there are 24 (twenty four) sorted rack stock yards 18. Pusher mechanisms, each of which include a solenoid valve, a pneumatic cylinder 20, and a pusher member 21 is associated with each of the sorted rack stock yards 18. Each pusher mechanism is adapted for stopping its operation when a rack fill-up indicator lamp 24 indicates that the associated sorted rack stock yard 18 is filled up. Each sorted rack stock yard 18 is provided therein with a rack oscillation prevention member 25 which is adapted to be progressively moved inward as racks 23 are successively moved into the coarse sorted rack stock yard 18.

An NG rack stock yard 26 is disposed outside the downstream partition 17 which defines the most downstream sorted rack stock yard 18.

Both the rack transporting conveyor 2 and the rack sorting conveyor 3 are adapted to be driven intermittently. A transfer mechanism 27 is disposed to transfer racks from each rack supply conveyor 5 to the rack transporting conveyor 2. Another transfer mechanism 28 is used for transferring racks from the rack transporting conveyor 2 to the rack sorting conveyor 3.

Figure 2:
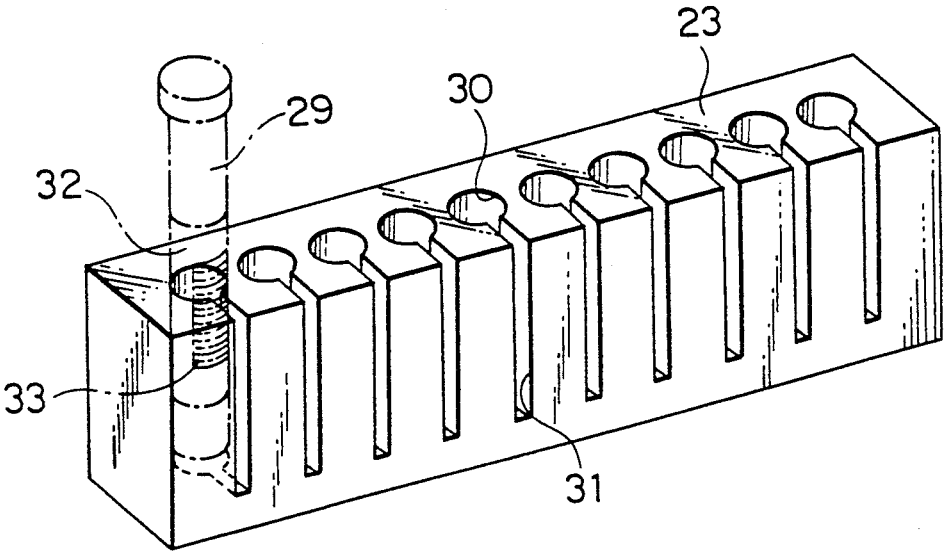
FIGS. 2 and 3 are illustrations of racks for accommodating specimen containers.
Figure 3:
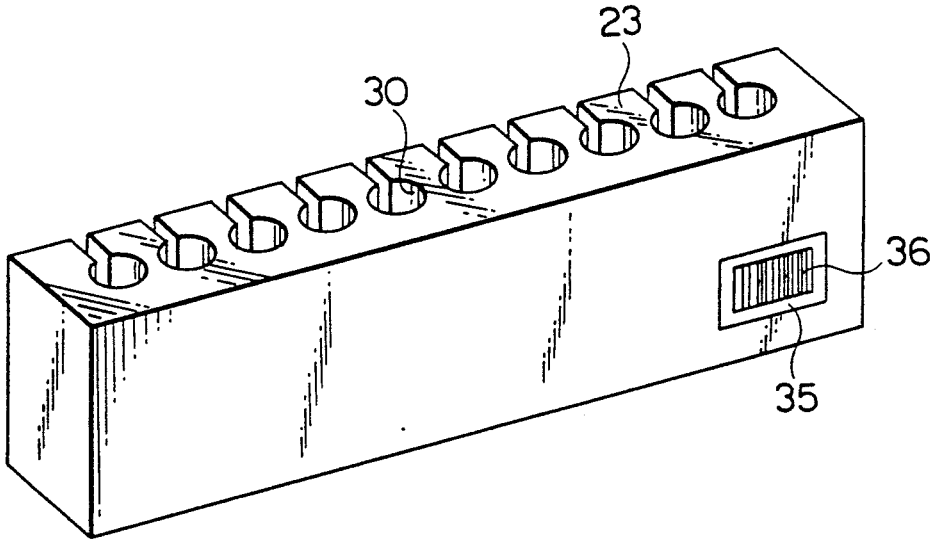
Figure 4:
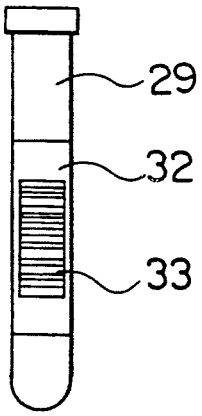
FIG. 4 is a schematic illustration of a specimen container.

As will be seen from FIGS. 2 and 3, the rack 23 has a rectangular parallelopiped form and has a plurality of holes 30 into which specimen containers 29 filled with specimens are inserted and withdrawn from. In the illustrated case, there are ten holes 30. One side wall of the rack 23 is vertically notched to provide slots 31 which communicate with the respective holes 30. The arrangement is such that the bar codes 33 on $ID_0$No-bar code labels 32 adhered to the specimen containers 29 are readable through these slots 31.

Specimen containers 29 containing specimens from different subjects are delivered to a central laboratory and are introduced into the sorting apparatus 1 of the present invention. The specimen containers are then coarsely sorted in accordance with analysis and examination items which have been previously input to the computer, and are sent for analysis and examination.

The examination item identification number $ID_2$No is printed in two lines: namely, in upper and lower stages. Serial numbers are given as the examination item identification numbers $ID_2$No to successive specimens in the same rack. Thus, specimens in the same rack have independent identification numbers.

Numeral 34 designates a control panel including a computer.

The operation of the apparatus having the described construction is as follows.

The sorting data demand items for the respective lots of specimens, which are shown on the received specimen containers, are input by each operator to the computer. At the same time, the computer receives sorting information data from the host computer 14 and stores such data.

The sorting information transmitted from the host computer 14 includes, in addition to the sorting number, all the items necessary for the sorting including items requiring manual sorting work.

The operator then enables the first specimen bar code reader 8 to read the bar codes 33 indicative of the specimen identification numbers $ID_0$No adhered to the specimen containers 29 one by one.

On the basis of the read identification numbers $ID_0$No., the computer retrieves the sorting information data stored therein and lights up the indicator lamp 10 indicative of the classes corresponding to the specimens or displays sorting items to enable a manual sorting work.

The operator then sets the specimen containers 29 in the corresponding sorting racks 23 in accordance with the indication of the lamps. When a display is made to inform that a certain specimen requires manual sorting, the operator pushes a cancel button (not shown) and stores such a container in a separate rack.

Racks 23 loaded with 10 (ten) specimen containers are transferred by the operator to the rack supply conveyor 5.

Empty sorting racks 23 are placed on the coarse sorting table 9 beforehand.

The rack 23 is transferred to the rack transporting conveyor 2 from the rack supply conveyor 5, and then during the intermittent convey, the rack bar code reader 12 reads the bar codes 36 on the rack number bar code label 35 bonded to the rack 23. At the same time, the bar codes 33 on the specimen identification number bar code label 32 bonded to the specimen containers 29 on the rack 23 are successively read by the second specimen bar code reader 13.

Thus, a check is conducted during the convey for any reading error of the operator, mixing of wrong specimens and insufficiency of the specimen containers in the rack. The computer then transmits the rack number and the specimen identification numbers $ID_0$No of the accepted rack to the host computer, thus demanding the host computer to deliver the examination identification number $ID_2$No. Rejected racks are ejected from the conveyor line through the NG stock yard 26.

Those racks which have passed the checking and printing steps are successively moved into the sorted rack stock yards 18 from the rack sorting conveyor 3 by the pusher mechanisms which selectively operate in accordance with the instructions given by the host computer.

A fill-up indicator lamp 24 is lit when the respective sorted rack stock yard 18 has become full, and the racks 23 thus filling up the rack stock yard 18 are then taken out.

The specimens coarsely sorted on the coarse sorting table 9 by the operator are thus sorted automatically by the apparatus of the present invention.

As will be understood from the foregoing description, according to the present invention, the specimens received in the central laboratory are coarsely sorted in accordance with predetermined classes and are then sorted after automatic printing of the examination identification number $ID_2No$ which are given by the host computer. As a consequence, the efficiency of the work for sorting specimens is remarkably improved.

What is claimed is:

1. A specimen sorting apparatus, comprising:

a path of convey including a rack transporting conveyor and a rack sorting conveyor connected to the downstream end of said rack transporting conveyor;

a rack supply conveyor provided at one side of said rack transporting conveyor;

a first specimen bar code reader disposed in the vicinity of said rack supply conveyor;

a printer disposed near the downstream end of said rack transporting conveyor and adapted to operate in accordance with instructions given by a host computer;

a rack bar code reader and a second specimen bar code reader disposed along the path of convey between said rack supply conveyor and said printer;

a table disposed at one side of said rack sorting conveyor and having a predetermined number of storage sections defined thereon; and a plurality of pusher mechanisms arranged along said rack sorting conveyor and associated with the respective storage sections;

whereby the sorting of specimens is conducted by loading predetermined racks with a predetermined number of specimen containers in accordance with a specimen identification number $ID_0No$ marked on said specimen containers and read by the first specimen bar code reader; transferring the racks onto said rack supply conveyor and then to said rack transporting conveyor; reading the rack identification number of each rack by said rack bar code reader and reading the specimen identification numbers $ID_0No$ of the specimen containers on said rack by said second specimen bar code reader during the running of said rack by said rack transporting conveyor; printing examination item identification numbers $ID_2No$ on said specimen containers by said printer in accordance with instructions given by a host computer; transferring said racks after printing on said specimen containers thereon to said rack sorting conveyor from said rack transporting conveyor; and selectively operating said pusher mechanisms in accordance with instructions given by said host computer thereby pushing said racks into corresponding storage sections.

2. A specimen sorting apparatus according to claim 1, wherein said pusher mechanism includes a pneumatic cylinder and a pusher member.

3. A specimen sorting apparatus according to claim 1, wherein said storage section is defined by partition walls, a rack stock yard and a rack oscillation prevention member.

* * * * *